US010234785B2

(12) United States Patent
Tsutsumi

(10) Patent No.: US 10,234,785 B2
(45) Date of Patent: Mar. 19, 2019

(54) CHARGING DEVICE AND IMAGE FORMING DEVICE INCLUDING THE SAME

(71) Applicant: KYOCERA Document Solutions Inc., Osaka-shi, Osaka (JP)

(72) Inventor: Masahiro Tsutsumi, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/835,510

(22) Filed: Dec. 8, 2017

(65) Prior Publication Data

US 2018/0173131 A1 Jun. 21, 2018

(30) Foreign Application Priority Data

Dec. 9, 2016 (JP) ..... 2016-239667

(51) Int. Cl.
*G03G 15/02* (2006.01)
*G03G 15/00* (2006.01)
*G03G 21/20* (2006.01)

(52) U.S. Cl.
CPC ..... *G03G 15/0266* (2013.01); *G03G 15/0291* (2013.01); *G03G 15/553* (2013.01); *G03G 21/20* (2013.01)

(58) Field of Classification Search
CPC ..... G03G 15/0266
See application file for complete search history.

(56) References Cited

U.S. PATENT DOCUMENTS 5,181,070 A * 1/1993 Masuda ..... G03G 15/0266 399/171
5,250,992 A * 10/1993 Tsuneeda ..... G03G 15/0266 361/229
5,309,207 A * 5/1994 Omori ..... G03G 15/065 361/225
5,367,366 A * 11/1994 Kido ..... G03G 15/0266 399/315
5,572,295 A * 11/1996 Sakagami ..... G03G 15/0266 399/50

(Continued)

FOREIGN PATENT DOCUMENTS

JP H10-142904 A 5/1998

*Primary Examiner* — David J Bolduc
(74) *Attorney, Agent, or Firm* — Viering, Jentschura & Partner mbB

(57) ABSTRACT

A parameter detection unit detects a first factor parameter that corresponds to change in layer thickness of an organic photosensitive layer in a photoreceptor drum and a second factor parameter other than the first factor parameter. A discharge voltage applying unit and a grid voltage applying unit are controlled by a first charging control unit and a second charging control unit. The first charging control unit determines a charging current for a discharge wire of the discharge voltage applying unit in accordance with a detection value of the first factor parameter, which has been detected by the parameter detection unit. On the other hand, the second charging control unit determines an output voltage that corresponds to a grid electrode of the grid voltage applying unit in accordance with a detection value of the second factor parameter, which has been detected by the second charging control unit.

5 Claims, 5 Drawing Sheets

(56) References Cited

U.S. PATENT DOCUMENTS

| | | | | |
|---|---|---|---|---|
| 5,659,839 | A * | 8/1997 | Mizude | G03G 15/0266 399/50 |
| 5,796,103 | A * | 8/1998 | Sakai | G03G 15/0266 250/324 |
| 5,812,905 | A * | 9/1998 | Yoo | G03G 15/0266 361/221 |
| 6,345,159 | B1 * | 2/2002 | Suzuki | G03G 15/0266 250/325 |
| 2005/0200309 | A1 * | 9/2005 | Kamiya | G03G 15/0283 315/291 |
| 2010/0080593 | A1 * | 4/2010 | Inukai | G03G 15/0266 399/50 |
| 2012/0051762 | A1 * | 3/2012 | Maruyama | G03G 15/0266 399/31 |
| 2012/0057888 | A1 * | 3/2012 | Inukai | G03G 15/0266 399/50 |
| 2012/0195616 | A1 * | 8/2012 | Miyahara | G03G 15/0266 399/55 |
| 2013/0108295 | A1 * | 5/2013 | Kanehara | G03G 15/0266 399/50 |
| 2015/0023677 | A1 * | 1/2015 | Kanehara | G03G 15/0266 399/50 |
| 2015/0177637 | A1 * | 6/2015 | Satoh | G03G 15/0266 399/50 |
| 2016/0161878 | A1 * | 6/2016 | Kitajima | G03G 15/0266 399/50 |
| 2018/0046122 | A1 * | 2/2018 | Kitajima | G03G 15/0233 |
| 2018/0143561 | A1 * | 5/2018 | Kitajima | G03G 15/02 |

* cited by examiner

CHARGING DEVICE AND IMAGE FORMING DEVICE INCLUDING THE SAME

CROSS REFERENCE TO RELATED APPLICATIONS

The disclosure of Japanese Patent Application No. 2016-239667 filed on Dec. 9, 2016, including the specification, drawings and abstract is incorporated herein by reference in its entirety.

BACKGROUND

The present disclosure relates to a charging device that charges a surface of a photoreceptor to a predetermined charging potential and an image forming device including the charging device.

An electrophotographic image forming device, such as a copy machine, a printer, a facsimile device, a multifunction peripheral, or the like, includes a charging device that charges a surface of a photoreceptor to a predetermined charging potential in order to enable formation of an electrostatic latent image on the surface of the photoreceptor. As the charging device, there is a scorotron charging device including a discharge electrode that generates corona discharge between the photoreceptor and the discharge electrode and a grid electrode that is arranged between the discharge and the photoreceptor electrode.

Coincidently, a surface potential of the photoreceptor that has been charged by the charging device is required to be a potential suitable for development in a developing position in which an electrostatic latent image is developed by a developing device. On the other hand, the charging performance of the photoreceptor is influenced by change in layer thickness due to a shave of a photosensitive layer, which is generated by use of the photoreceptor, and change in temperature and humidity of a surrounding environment of the photoreceptor, and thus, varies. That is, in the scorotron charging device, in a state in which each of a discharge voltage that is applied to the discharge electrode and a grid voltage that is applied to the grid electrode is maintained constant, the surface potential of the photoreceptor varies in accordance with change in layer thickness of the photosensitive layer and change in temperature and humidity. Therefore, the surface potential of the photoreceptor cannot be maintained at a potential which is suitable for development.

As a technology that solves the above-described problem, a technology in which charging control of the charging device is performed in accordance with change in layer thickness of the photosensitive layer and change in temperature and humidity has been conventionally known. In the conventionally known technology, in a state in which a discharge voltage that is applied to the discharge electrode is maintained constant, a grid voltage that is applied to the grid electrode is controlled, based on a count value of the number of copies and detection values of a temperature and a humidity, which are parameters that correspond to change in layer thickness of the photosensitive layer.

SUMMARY

A charging device according to an aspect of the present disclosure is a charging device that is attached to an image forming device including a photoreceptor in which a photosensitive layer that is able to carry an electrostatic latent image is formed on a surface thereof and which is rotationally driven and a developer carrying body which carries a developer, is rotationally driven, and develops the electrostatic latent image by the developer with a predetermined developing bias applied thereto, and charges the surface of the photoreceptor in advance of carrying the electrostatic latent image. The charging device includes a discharge electrode that generates corona discharge between the photoreceptor and the discharge electrode and a grid electrode arranged between the discharge electrode and the photoreceptor and charges the surface of the photoreceptor to a predetermined charging potential, a discharge voltage applying unit that outputs a discharge voltage that is to be applied to the discharge electrode under constant current control, a grid voltage applying unit that outputs a grid voltage that is to be applied to the grid electrode under constant voltage control, a parameter detection unit that detects a first factor parameter that is a parameter that is a change factor of a surface potential of the photoreceptor that has been charged by the charging unit and corresponds to change in layer thickness of the photosensitive layer in the photoreceptor and a second factor parameter other than the first factor parameter, a storage unit that stores first information in which the first factor parameter and a charging current that flows when the discharge voltage is applied to the discharge electrode of the discharge voltage applying unit are associated with one another and second information in which the second factor parameter and an output voltage of the grid voltage applying unit are associated with one another, and a control unit that controls the discharge voltage applying unit and the grid voltage applying unit such that the surface potential of the photoreceptor is the predetermined charging potential. The control unit includes a first charging control unit that determines a charging current of the discharge voltage applying unit, which corresponds to a detection value of the first factor parameter, which has been detected by the parameter detection unit, with reference to the first information that is stored in the storage unit and causes the discharge voltage applying unit to output a discharge voltage with the charging current under constant current control, and a second charging control unit that determines an output voltage of the grid voltage applying unit, which corresponds to a detection value of the second factor parameter, which has been detected by the parameter detection unit, with reference to the second information that is stored in the storage unit and causes the grid voltage applying unit to output a grid voltage at the output voltage under constant voltage control.

An image forming device according to another aspect of the present disclosure includes a photoreceptor in which a photosensitive layer that is able to carry an electrostatic latent image is formed on a surface thereof and which is rotationally driven, a developer carrying body which carries a developer, is rotationally driven, and develops the electrostatic latent image by the developer with a predetermined developing bias applied thereto, and the above-described charging device which charges the surface of the photoreceptor in advance of carrying the electrostatic latent image.

DETAILED DESCRIPTION

A charging device and an image forming device according to an embodiment of the present disclosure will be described below with reference to the accompanying drawings. Note that a directional relationship will be described below using an XYZ orthogonal coordinate axes. An X direction, a Y direction, and a Z direction correspond to a left-and-right direction (+X is right and −X is left), a front-and-rear direction (+Y is front and −Y is rear), and a vertical direction (+Z is up and −Z is down), respectively. Also, in the following description, the term "sheet" means copy paper, coated paper, an OHP sheet, cardboard, a post card, tracing paper, some other sheet material on which image forming processing is performed, or a sheet material on which some other arbitrary processing than image forming processing is performed.

[Entire Structure of Image Forming Device]

Figure 1:
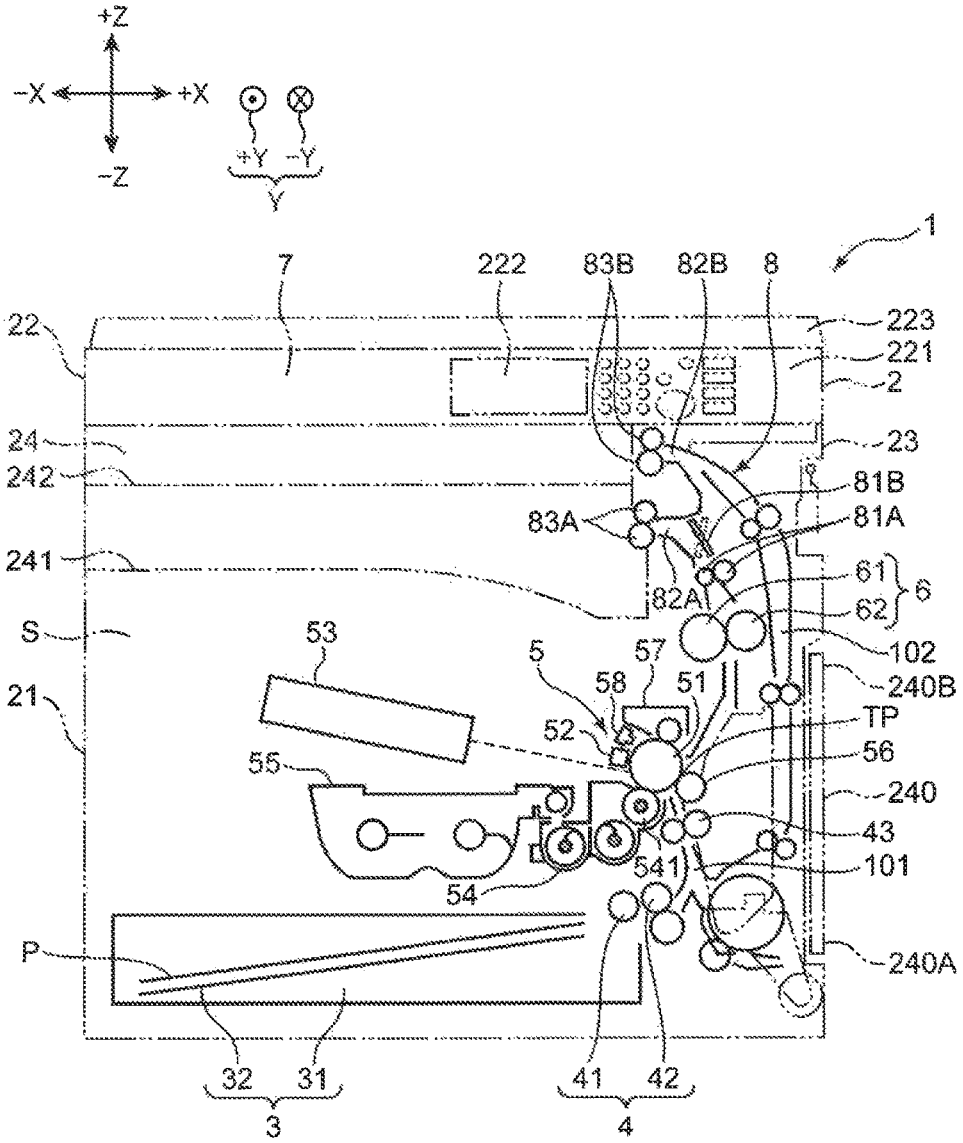
FIG. 1 is a view schematically illustrating an internal structure of an image forming device including a charging device according to an embodiment.

FIG. 1 is a view schematically illustrating an internal structure of an image forming device 1 according to an embodiment. The image forming device 1 is an electrophotographic device that forms an image on a sheet P. In this case, as the image forming device 1, a monochromatic copying machine is illustrated as an example, but the image forming device 1 may be a printer, a facsimile device, or a multifunction peripheral having functions of the above-described devices and, as another option, may be a device that forms a color image.

The image forming device 1 includes a device body 2, a sheet storing unit 3 that is arranged in the device body 2, a paper feeding unit 4, an image forming unit 5, a fixing unit 6, an image reading unit 7, and a sheet discharging unit 8.

The device body 2 includes a lower housing 21 having a rectangular parallelepiped shape when externally viewed and an upper housing 22 having a rectangular parallelepiped shape and arranged above the lower housing 21 so as to be opposed to the lower housing 21. The lower housing 21 and the upper housing 22 are connected to one another via a connecting unit 23 that forms a part of the lower housing 21. The connecting unit 23 is arranged to erect from a side portion of the lower housing 21 located at the +X side (the right side). A portion of the upper housing 22 located in an area at the +X side (the right side) is supported by an end portion (an upper end portion) of the connecting unit 23 located at the +Z side (the upper side). The sheet P on which image forming processing has been performed is discharged to a discharge space 24 surrounded by the lower housing 21, the upper housing 22, and the connecting unit 23 by the sheet discharging unit 8.

The image reading unit 7 is arranged in the upper housing 22. The image reading unit 7 is a device that reads an image of an original document and includes an original document holding cover 223 arranged at the +Z side (the upper side) of the upper housing 22. The original document holding cover 223 is attached to the upper housing 22 so as to be rotatable in the up-and-down direction and is used for holding an original document. Analog information of the image of the original document which has been read by the image reading unit 7 is converted to a digital signal, and then, is output to a light exposure device 53, which will be described later, and image forming processing is performed thereon.

Also, an operation unit 221 is arranged in a portion of the upper housing 22 located in an area at the +Y side (the front side). The operation unit 221 includes, for example, a liquid crystal display (LCD) touch panel 222. The operation unit 221 is configured to be able to input information related to image forming processing. A user can input the number of sheets P that are to be printed or the like, input printing density, or the like, for example, via the LCD touch panel 222.

A manual feed tray 240 is arranged in a side portion of the lower housing 21 located at the +X side (the right side). The manual feed tray 240 is arranged so as to be rotatable such that a portion of the manual feed tray 240 located at an upper end 240B side moves in the up-and-down direction with a lower end 240A of the manual feed tray 240 serving as a fulcrum. The manual feed tray 240 is configured such that an attitude of the manual feed tray 240 is changeable between a close attitude in which the manual feed tray 240 stands so as to close a manual paper feeding port and an open attitude in which the manual feed tray 240 projects to the +X side (the right side). The manual feed tray 240 is put in a state in which an attitude setting is the open attitude to manually feed the sheets P one by one.

The sheet storing unit 3, the paper feeding unit 4, the image forming unit 5, the fixing unit 6, and the sheet discharging unit 8 are arranged in an internal space S of the lower housing 21.

The sheet storing unit 3 is provided so as to be freely inserted to or removed from the lower housing 21 and includes a cassette 31 that stores the sheets P and a lift plate 32 that supports the sheets P in the cassette 31. The lift plate 32 is inclined so as to push up a front edge of the sheets P to the +Z side (the upper side).

The paper feeding unit 4 includes a pickup roller 41 and a paper feeding roller 42. In the paper feeding unit 4, the pickup roller 41 and the paper feeding roller 42 send the sheets P stored in the cassette 31 to a sheet conveying route 101 one by one. The sheet conveying route 101 is a conveying route arranged so as to extend from the paper feeding unit 4 and pass a transfer position TP in the image forming unit 5 via a resistance roller pair 43. The resistance roller pair 43 defines a position of the sheet P in a direction orthogonal to a sheet conveying direction. The resistance roller pair 43 conveys each of the sheets P to the image forming unit 5 in accordance with a timing at which a toner image (a developer image) is transferred to the sheet P in the image forming unit 5.

Figure 2:
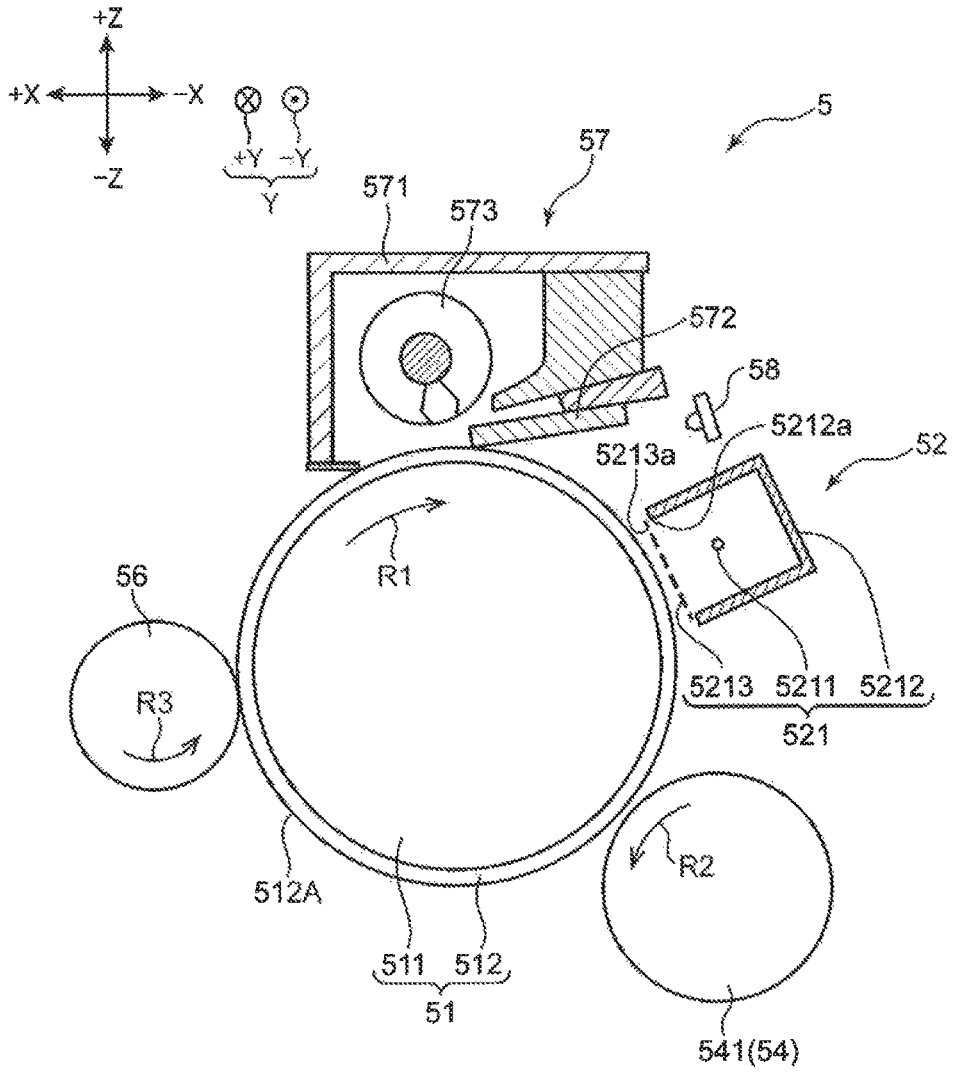
FIG. 2 is a view illustrating a structure of an image forming unit of the image forming device.

The image forming unit 5 performs image forming processing on the sheet P which has been supplied by the paper feeding unit 4. The image forming unit 5 will be described with reference to FIG. 2 as well as FIG. 1. FIG. 2 is a view illustrating a structure of the image forming unit 5 of the image forming device 1. The image forming unit 5 includes a photoreceptor drum 51, a charging device 52, a light exposure device 53, a developing device 54, a toner container 55, a transfer roller 56, a cleaning device 57, and a destaticizer 58.

The photoreceptor drum 51 is a cylindrical drum that is rotationally driven in a rotation direction R1 illustrated in FIG. 2 around a rotary shaft that extends in the Y direction (the front-and-rear direction) and is an organic photoreceptor in which an organic photosensitive layer 512 made of an organic photosensitive material is formed on an outer peripheral surface of a conductive base 511 made of aluminum or the like. The photoreceptor drum 51 carries an electrostatic latent image and also a toner image that corresponds to the electrostatic latent image on a surface 512A that forms an outer peripheral surface of the organic photosensitive layer 512.

The charging device 52 charges the surface 512A of the photoreceptor drum 51 in advance of carrying an electrostatic latent image. A detailed configuration of the charging device 52 will be described later.

The light exposure device 53 irradiates the surface 512A of the photoreceptor drum 51, which has been charged by the charging device 52, with laser light to form an electrostatic image thereon. The developing device 54 includes a developing roller 541 that supplies a toner (a developer) to the surface 512A of the photoreceptor drum 51 on which an electrostatic latent image has been formed. The developing roller 541 is a roller that is rotationally driven in a rotation direction R2 illustrated in FIG. 2 around a rotary shaft that extends in parallel to the photoreceptor drum 51 and is able to carry the toner. With a predetermined development bias applied, the developing roller 541 develops the electrostatic latent image that has been formed on the surface 512A of the photoreceptor drum 51 by the toner that is carried. Also, the toner container 55 supplies a replenishing toner to the developing device 54.

The sheet P is sent to the photoreceptor drum 51 on which development has been performed by the developing device 54 and a toner image has been formed via the sheet conveying route 101 and the resistance roller pair 43. The transfer roller 56 is a roller that transfers the toner image that has been formed on the surface 512A of the photoreceptor drum 51 to the sheet P at the transfer position TP. The transfer roller 56 is able to rotate in a rotation direction R3 illustrated in FIG. 2 around a rotary shaft that extends in parallel to the photoreceptor drum 51 and contacts the surface 512A of the photoreceptor drum 51 to form a transfer nip unit. A transfer bias of an opposite polarity to a polarity of the toner is applied to the transfer roller 56. The sheet P to which the toner image has been transferred is separated from the photoreceptor drum 51 and is sent to the fixing unit 6.

The cleaning device 57 includes a cleaning blade 572 and a recovery spiral 573 which are arranged in a housing 571. The cleaning blade 572 is arranged in the housing 571 such that a tip end portion of the cleaning blade 572 contacts the surface 512A of the photoreceptor drum 51. The cleaning blade 572 removes an untransferred toner that has been adhered to the surface 512A of the photoreceptor drum 51 after the toner image has been transferred. The untransferred toner that has been removed from the photoreceptor drum 51 by the cleaning blade 572 is conveyed to a toner recovery box, which is not illustrated, by the recovery spiral 573 and is recovered.

The destaticizer 58 irradiates the photoreceptor drum 51 the surface 512A of which has been cleaned by the cleaning device 57 with predetermined destaticizing light. As a result, residual electric charges on the surface 512A of the photoreceptor drum 51 are destaticized.

The fixing unit 6 performs fixing processing in which the toner image that has been transferred on the sheet P. The fixing unit 6 includes a fixing roller 61 including a heating source inside and a pressure roller 62 that pressure-contacts the fixing roller 61 to form a fixing nip unit between the pressure roller 62 and the fixing roller 61. When the sheet P to which the toner image has been transferred is sent through the fixing nip unit, the toner image is fixed on the sheet P by heat generated by the fixing roller 61 and pressure applied by the pressure roller 62.

The sheet P on which fixing processing has been performed is conveyed to a downstream side in the sheet conveying direction by a conveying roller pair 81A of the sheet discharging unit 8 arranged above the fixing unit 6. A discharge branching guide 81B is arranged in a downstream side of the conveying roller pair 81A. The discharge branching guide 81B has a function of switching the conveying direction of the sheet P in the downstream side of the conveying roller pair 81A in the sheet conveying direction. The sheet P the conveying direction of which has been switched by the discharge branching guide 81B is sent to a first discharge route 82A or a second discharge route 82B.

When the sheet P on which fixing processing has been performed is a sheet for single-side printing, the sheet P is discharged to the discharge space 24 by a first discharge roller pair 83A arranged in the first discharge route 82A, or is discharged to the discharge space 24 by a second discharge roller pair 83B arranged in the second discharge route 82B. The sheet P that has been discharged to the discharge space 24 by the first discharge roller pair 83A is loaded in a first sheet loading unit 241 arranged on an upper surface portion of the lower housing 21. Also, the sheet P that has been discharged to the discharge space 24 by the second discharge roller pair 83B is loaded in a second sheet loading unit 242 arranged above the first sheet loading unit 241.

On the other hand, when the sheet P on which fixing processing has been performed is a sheet for double-side printing on which single-side printing processing is completed, the sheet P is in a state of being held between the second discharge roller pair 83B arranged in the second discharge route 82B. In this state, the second discharge roller pair 83B is reversed to switch back the sheet P. Thus, the sheet P is reversely sent via a reverse sheet conveying route 102 and is supplied to the image forming unit 5 again continuously in a state of face-back inversion, and image forming processing is performed on a back side. The sheet P on which double-side printing is completed is discharged to the discharge space 24 via the first discharge route 82A or the second discharge route 82B of the sheet discharging unit 8.

[Detailed Configuration of Charging Device]

Figure 3:
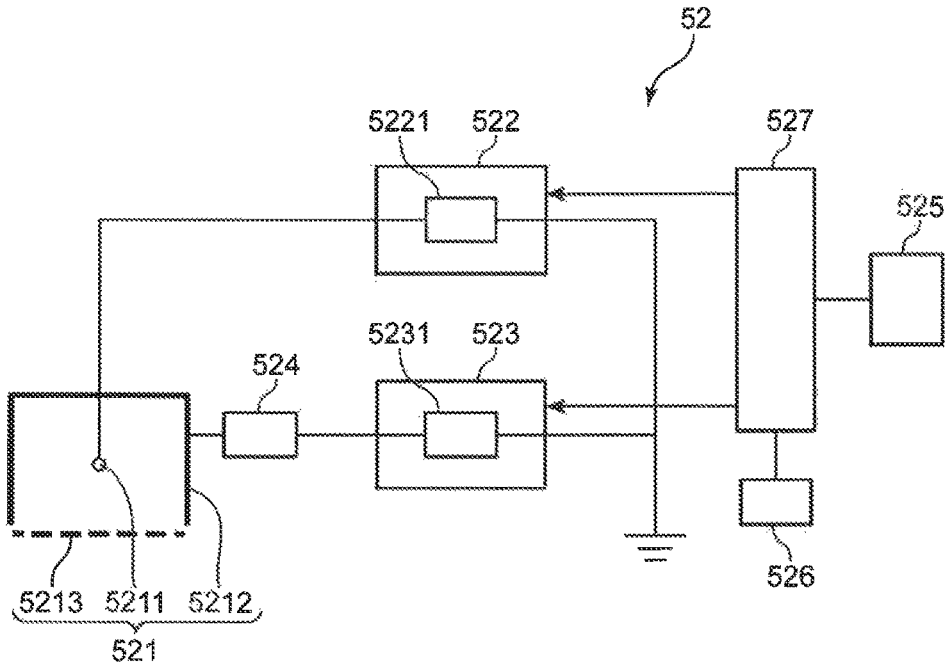
FIG. 3 is a diagram schematically illustrating a configuration of the charging device.
Figure 4:
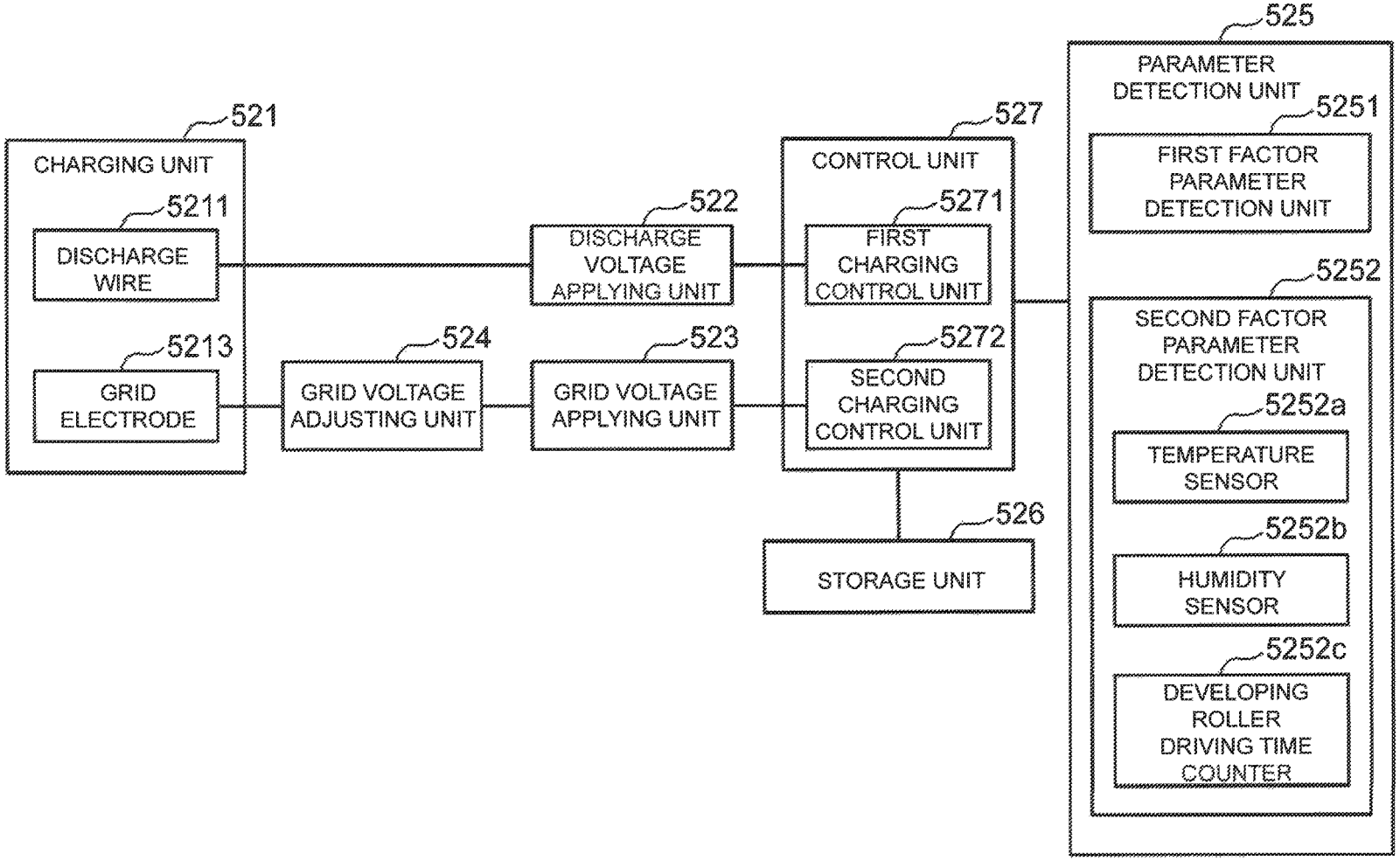
FIG. 4 is a block diagram illustrating an electrical configuration of the charging device.

Next, a configuration of the charging device 52 will be described in detail. The charging device 52 is a scorotron charging device that charges the surface 512A of the photoreceptor drum 51. A configuration of the charging device 52 will be described with reference to FIG. 3 and FIG. 4 in addition to FIG. 2. FIG. 3 is a diagram schematically illustrating a configuration of the charging device 52. FIG. 4 is a block diagram schematically illustrating an electrical configuration of the charging device 52.

The charging device 52 includes a charging unit 521, a discharge voltage applying unit 522, a grid voltage applying unit 523, a grid voltage adjusting unit 524, a parameter detection unit 525, a storage unit 526, and a control unit 527.

The charging unit 521 includes a discharge wire 5211, a shield case 5212 in which the discharge wire 5211 is accommodated, and a grid electrode 5213 that is attached to the shield case 5212. The discharge wire 5211 is a discharge electrode that generates corona discharge between the photoreceptor drum 51 and the discharge wire 5211 and extends in a rotary shaft direction (the Y direction, the front-and-rear direction) so as to be opposed to the photoreceptor drum 51. The shield case 5212 has a long box shape including an opening portion 5212*a* that opens to face the photoreceptor drum 51. The grid electrode 5213 is attached to the opening portion 5212*a* of the shield case 5212 so as to be interposed between the discharge wire 5211 and the photoreceptor drum 51. The charging unit 521 applies a high voltage to the discharge wire 5211 to generate corona discharge and charges the surface 512A of the photoreceptor drum 51 to a predetermined charging potential via the grid electrode 5213.

The discharge wire 5211 is stretched between both end portions of the shield case 5212 in a rotary shaft direction (the Y direction, the front-and-back direction) of the photoreceptor drum 51 in the shield case 5212. The grid electrode 5213 is a thin plate of a conductor in which holes 5213*a* in a mesh form are opened in a control area in which the charging potential is controlled and is locked at the both end portions in a longitudinal direction (the Y direction, the front-and-rear direction) of the shield case 5212 so as to cover the opening portion 5212*a* of the shield case 5212. Note that, although, in this embodiment, the grid electrode 5213 and the shield case 5212 are electrically conducted to make respective potentials thereof to be the same, the grid electrode 5213 and the shield case 5212 may be separated from one another to make respective application voltages that are applied to the grid electrode 5213 and the shield case 5212 different from one another.

The discharge voltage applying unit 522 is a power source unit that outputs a discharge voltage of a high voltage that is to be applied to the discharge wire 5211. The discharge voltage applying unit 522 includes a transformer 5221 and outputs, by the transformer 5221, the discharge voltage to the discharge wire 5211 under constant current control. The discharge voltage applying unit 522 outputs, for example, a discharge voltage of about 5 kV that generates corona discharge in the discharge wire 5211 under constant current control in which the charging current is maintained constant in a range of 100 μA to 800 μA.

The grid voltage applying unit 523 is a power source unit that outputs a grid voltage that is applied to the grid electrode 5213. The grid voltage applying unit 523 includes a constant voltage element 5231 and outputs, by the constant voltage element 5231, a grid voltage to the grid electrode 5213 under constant voltage control. The constant voltage element 5231 is, for example, a Zener diode. The grid voltage applying unit 523 outputs a grid voltage to the grid electrode 5213 under constant voltage control in which the grid voltage is maintained to be at a constant value, for example, in a range of 300 V to 600 V in order to converge a surface potential of the photoreceptor drum 51, which has been caused by corona discharge of the discharge wire 5211, to a predetermined charging potential.

The grid voltage adjusting unit 524 is coupled between the grid electrode 5213 and the grid voltage applying unit 523 and maintains the grid voltage that has been applied to the grid electrode 5213 by the grid voltage applying unit 523 constant. Fluctuations of the grid voltage in the grid electrode 5213 may be reduced by the grid voltage adjusting unit 524 coupled between the grid electrode 5213 and the grid voltage applying unit 523.

The grid voltage adjusting unit 524 is formed of at least one of a variable resistance element and a constant voltage element (for example, a Zener diode). The variable resistance element and the constant voltage element are elements which are able to maintain the grid voltage of the grid electrode 5213 constant. Therefore, fluctuations of the grid voltage in the grid electrode 5213 may be effectively reduced by using at least one of the elements as the grid voltage adjusting unit 524.

The parameter detection unit 525 is a detection unit that detects a parameter that is a change factor of the surface potential of the photoreceptor drum 51 that has been charged by the charging unit 521. The parameter detection unit 525 includes a first factor parameter detection unit 5251 and a second factor parameter detection unit 5252.

The first factor parameter detection unit 5251 detects a first factor parameter that is a parameter that is a change factor of the surface potential of the photoreceptor drum 51 and corresponds to change in layer thickness of the organic photosensitive layer 512 in the photoreceptor drum 51. When a first charging control unit 5271 of the control unit 527 which will be described later determines the charging current of the discharge voltage applying unit 522, the first factor parameter that is detected by the first factor parameter detection unit 5251 is referred to. Note that the charging current of the discharge voltage applying unit 522 is a current that flows when the discharge voltage applying unit 522 applies a discharge voltage to the discharge wire 5211 under constant current control.

Specifically, the first factor parameter that is detected by the first factor parameter detection unit 5251 is information of at least one of a rotary driving time, the number of rotations, and a travel distance of the photoreceptor drum 51. Note that the travel distance of the photoreceptor drum 51 is a calculation value obtained by multiplying a circumference of the photoreceptor drum 51 by the number of rotations. The rotary driving time, the number of rotations, and the travel distance of the photoreceptor drum 51 are parameters that correspond to change in layer thickness of the organic photosensitive layer 512 in the photoreceptor drum 51. Therefore, the first factor parameter detection unit 5251 detects information of at least one of the above-described parameters as the first factor parameter and the first charging control unit 5271 which will be described later determines the charging current of the discharge voltage applying unit 522 in accordance with a detection value of the detection, so that the surface potential of the photoreceptor drum 51 may be maintained at a predetermined charging potential which is suitable for development. In this embodiment, the first factor parameter detection unit 5251 is formed of a photoreceptor drum driving time counter so as to detect a rotary driving time of the photoreceptor drum 51 as the first factor parameter.

Figure 5:
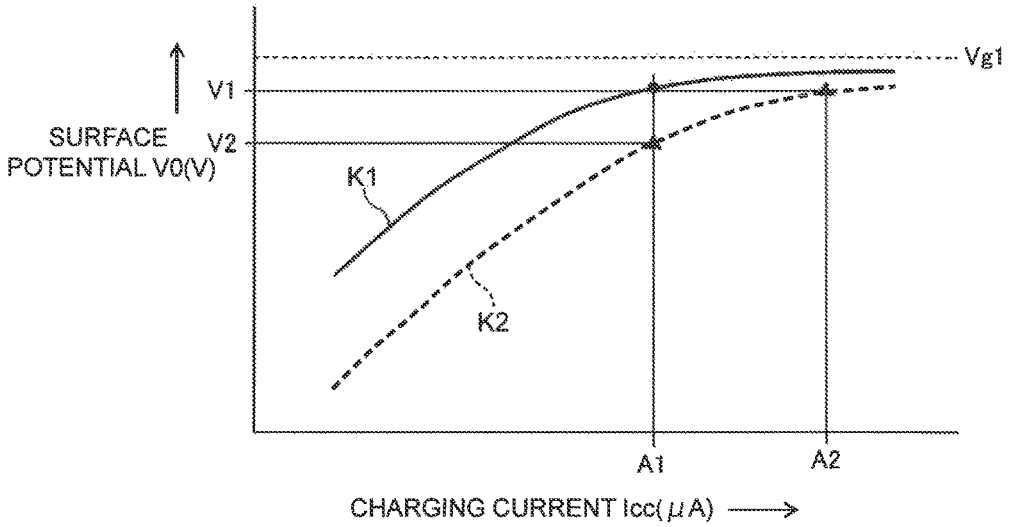
FIG. 5 is a graph illustrating a relationship between a charging current of a discharge wire and a surface potential of a photoreceptor drum.

FIG. 5 is a graph illustrating a relationship between the charging current of the discharge wire 5211 and the surface potential of the photoreceptor drum 51. In the graph of FIG. 5, the abscissa indicates the charging current (μA) of the discharge wire 5211 and the ordinate indicates the surface potential (V) of the photoreceptor drum 51. Also, in the graph of FIG. 5, a charging characteristic curve K1 indicated by a solid line is a characteristic curve that indicates a relationship between the charging current and the surface potential in an initial state in which there is no shave generated in the organic photosensitive layer 512 of the photoreceptor drum 51. In the graph of FIG. 5, a charging characteristic curve K2 indicated by a broken line is a characteristic curve that indicates a relationship between the charging current and the surface potential in a state in which there is a shave generated in the organic photosensitive layer 512 of the photoreceptor drum 51.

As the detection value of the first factor parameter, which has been detected by the first factor parameter detection unit 5251, increases, the amount of change (the amount of reduction) in layer thickness by the shave in the organic photosensitive layer 512 caused by use of the photoreceptor drum 51 increases. As the organic photosensitive layer 512 is shaved to be thinner by use of the photoreceptor drum 51, capacitance increases. Therefore, in a state in which an output voltage (a grid voltage) which is applied to the grid electrode 5213 of the grid voltage applying unit 523 is held at an initial grid voltage value Vg1 illustrated in FIG. 5 and the charging current for the discharge wire 5211 of the discharge voltage applying unit 522 is constantly held at an initial charging current value A1 illustrated in FIG. 5, the surface potential of the photoreceptor drum 51 is reduced to be a surface potential V2, which is lower than a predetermined charging potential V1 that is a target default value. In other words, as the detection value of the first factor parameter, which has been detected by the first factor parameter detection unit 5251, increases, the amount of reduction of the surface potential of the photoreceptor drum 51 increases.

The second factor parameter detection unit 5252 detects the second factor parameter, other than the first factor parameter, which is a parameter that is a change factor of the surface potential of the photoreceptor drum 51. When a second charging control unit 5272 of the control unit 527, which will be described later, determines the output voltage of the grid voltage applying unit 523, the second factor parameter that has been detected by the second factor parameter detection unit 5252 is referred to.

Specifically, the second factor parameter that is detected by the second factor parameter detection unit 5252 is information of at least one of temperature and humidity information (temperature and humidity information) of a surrounding environment of the photoreceptor drum 51 and information related to the rotary driving time of the developing roller 541. The temperature and humidity information of the surrounding environment of the photoreceptor drum 51 and the information related to the rotary driving time of the developing roller 541 are parameters that may be used as change factors of the surface potential of the photoreceptor drum 51, other than change in layer thickness of the organic photosensitive layer 512 in the photoreceptor drum 51. Therefore, the second factor parameter detection unit 5252 detects at least one of the above-described information as the second factor parameter and the second charging control unit 5272 controls the output voltage of the grid voltage applying unit 523 in accordance with a detection value of the detection, so that the surface potential of the photoreceptor drum 51 may be maintained at a predetermined charging potential which is suitable for development while a concern, such as increase in ozone generation amount or the like, is reduced as much as possible.

In this embodiment, the second factor parameter detection unit 5252 includes a temperature sensor 5252*a*, a humidity sensor 5252*b*, and a developing roller driving time counter 5252*c* and is configured to detect a temperature around the photoreceptor drum 51 by the temperature sensor 5252*a*, detect a humidity around the photoreceptor drum 51 by the humidity sensor 5252*b*, and detect information related to the rotary driving time of the developing roller 541 by the developing roller driving time counter 5252*c*.

When the temperature and the humidity in the surrounding environment of the photoreceptor drum 51 change (increase), dark attenuation of the surface potential changes between a charging position of the photoreceptor drum 51 and a developing position thereof and the surface potential reduces. In other words, as the detection value related to the temperature and the humidity around the photoreceptor drum 51, as the second factor parameter, which has been detected by the second factor parameter detection unit 5252, increases, the amount of reduction of the surface potential of the photoreceptor drum 51 increases. In this case, the charging position of the photoreceptor drum 51 is an area that is opposed to the charging unit 521 on the surface 512A of the photoreceptor drum 51 and the developing position of the photoreceptor drum 51 is an area that is opposed to the developing roller 541 on the surface 512A of the photoreceptor drum 51.

Also, there is a case in which, when the rotary driving time of the developing roller 541 increases and the toner is degraded in the developing device 54, or when a surrounding environment of the developing device 54 changes, image density changes. Therefore, in order to maintain the image density constant, there is a case in which the output value of the development bias is changed in accordance with the rotary driving time of the developing roller 541. In this case, when only the output value of the development bias is changed, image quality might be influenced, and therefore, a predetermined charging potential used in charging the photoreceptor drum 51 by the charging unit 521 is also changed simultaneously with changing the output value of the development bias. That is, when the rotary driving time of the developing roller 541, which is to be an index used in changing the output value of the development bias in order to maintain the image density constant, increases, the surface potential of the photoreceptor drum 51 has apparently reduced, as compared to the predetermined charging potential that corresponds to change in output value of the development bias. In other words, as the detection value related to the rotary driving time of the developing roller 541 as the second factor parameter, which has been detected by the second factor parameter detection unit 5252, increases, apparently, the amount of reduction in surface potential of the photoreceptor drum 51 increases.

The storage unit 526 stores the initial charging current value A1, an initial grid voltage Vg1, and a predetermined charging potential V1 illustrated in FIG. 5 in an initial state in which the detection value of the first factor parameter, which has been detected by the first factor parameter detection unit 5251, is an initial value and the detection value of the second factor parameter, which has been detected by the second factor parameter detection unit 5252, is an initial value. The initial charging current value A1 is a charging current for the discharge wire 5211 of the discharge voltage applying unit 522 in an initial state. The initial grid voltage Vg1 is an output voltage (a grid voltage) for the grid electrode 5213 of the grid voltage applying unit 523 in an initial state. The predetermined charging potential V1 is a target default value of the surface potential in the photoreceptor drum 51 when the photoreceptor drum 51 is charged by the charging unit 521.

Furthermore, the storage unit 526 stores first information in which the first factor parameter and the charging current that flows when a discharge voltage is applied to the discharge wire 5211 of the discharge voltage applying unit 522 are associated with one another and second information in which the second factor parameter and the output voltage (the grid voltage) of the grid voltage applying unit 523 are associated with one another. In this embodiment, the storage unit 526 stores, as the first information, information in which the rotary driving time of the photoreceptor drum 51 and the charging current of the discharge voltage applying unit 522 are associated with one another. Also, the storage unit 526 stores, as the second information, information in which temperature and humidity information of the surrounding environment of the photoreceptor drum 51, information related to the rotary driving time of the developing roller 541, and the output voltage (the grid voltage) of the grid voltage applying unit 523 are associated with one another.

The control unit 527 includes a central processing unit (CPU), a read only memory (ROM) which stores a control program, a random access memory (RAM) which is used as a work area of the CPU, and the like. The CPU executes the control program stored in the ROM, and thereby, the control unit 527 controls each of the discharge voltage applying unit 522 and the grid voltage applying unit 523 such that the surface potential of the photoreceptor drum 51 is the predetermined charging potential V1. In this embodiment, the control unit 527 includes the first charging control unit 5271 and the second charging control unit 5272.

The first charging control unit 5271 determines the charging current of the discharge voltage applying unit 522, which corresponds to the detection value of the first factor parameter, which has been detected by the first factor parameter detection unit 5251, such that the surface potential of the photoreceptor drum 51 is the predetermined charging potential V1 with reference to the first information stored in the storage unit 526.

To describe a control operation of the first charging control unit 5271 with reference to FIG. 5, when, due to change in layer thickness by a shave of the organic photosensitive layer 512, which has been caused by use of the photoreceptor drum 51, the surface potential of the photoreceptor drum 51 is the surface potential V2 which is lower than the predetermined charging potential V1, the first charging control unit 5271 determines the charging current for the discharge wire 5211 of the discharge voltage applying unit 522 to be the correction charging current value A2 that is higher than the initial charging current value A1 with reference to the first information stored in the storage unit 526. The first charging control unit 5271 causes the discharge voltage applying unit 522 to output a discharge voltage with the charging current at the determined correction charging current value A2 under constant current control. Thus, even when the amount of change in surface potential of the photoreceptor drum 51 due to change in layer thickness of the organic photosensitive layer 512 is large, the surface potential of the photoreceptor drum 51 may be maintained at the predetermined charging potential V1 which is suitable for development.

In this case, when the charging current of the discharge voltage applying unit 522 is increased, increase in ozone generation amount, increase in silica adhesion to the discharge wire 5211, and increase in discharge product adhesion to the grid electrode 5213 are concerned. Therefore, control of the charging current for the discharge wire 5211 of the discharge voltage applying unit 522 needs to be executed only on change in surface potential of the photoreceptor drum 51 due to change in layer thickness of the organic photosensitive layer 512.

Then, the second charging control unit 5272 determines the output voltage (the grid voltage) of the grid voltage applying unit 523 in accordance with the detection value of the second factor parameter other than the first factor parameter that corresponds to change in layer thickness of the organic photosensitive layer 512, which has been detected by the second factor parameter detection unit 5252, with reference to the second information stored in the storage unit 526. That is, for the detection value of the second factor parameter, the second charging control unit 5272 does not perform control of the charging current of the discharge voltage applying unit 522, but executes only control of the output voltage (the grid voltage) of the grid voltage applying unit 523.

Figure 6:
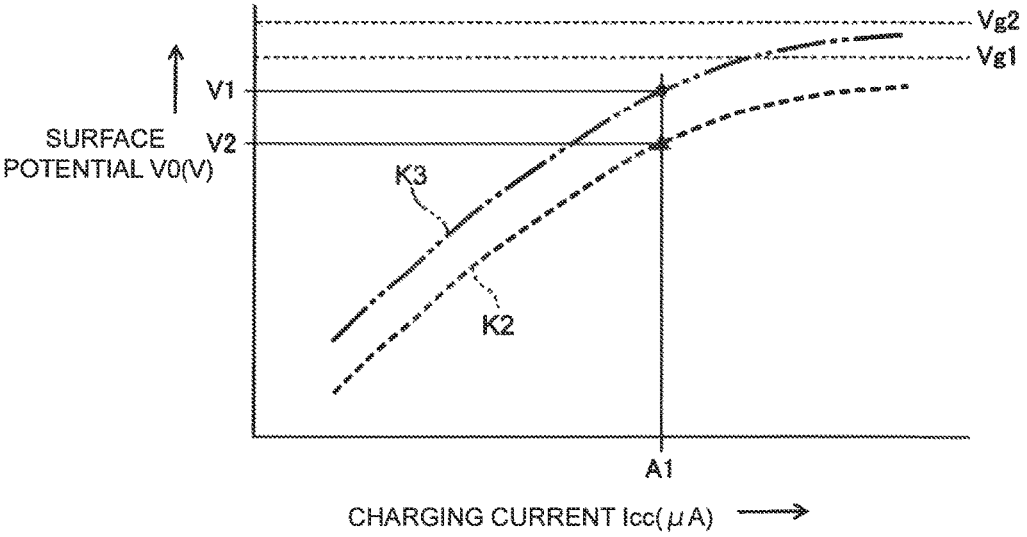
FIG. 6 is a graph illustrating a relationship between a charging current of a discharge wire and a surface potential of a photoreceptor drum when a grid voltage of a grid electrode is changed.

With reference to FIG. 6, a control operation of the second charging control unit 5272 will be described as follows. FIG. 6 is a graph illustrating a relationship between the charging current of the discharge wire 5211 and the surface potential of the photoreceptor drum 51 when the grid voltage of the grid electrode 5213 is changed. In the graph of FIG. 6, the abscissa indicates the charging current (μA) of the discharge wire 5211 and the ordinate indicates the surface potential (V) of the photoreceptor drum 51. Also, in the graph of FIG. 6, similar to FIG. 5, the charging characteristic curve K2 indicated by a broken line is a characteristic curve that indicates a relationship between the charging current and the surface potential in a state in which there is a shave generated in the organic photosensitive layer 512 of the photoreceptor drum 51. In the graph of FIG. 6, a charging characteristic curve K3 indicated by an alternate long and two short dashes line is a characteristic curve that indicates a relationship between the charging current and the surface potential in a state in which the grid voltage of the grid electrode 5213 is set to be a correction grid voltage Vg2 which is higher than the initial grid voltage Vg1 by the second charging control unit 5272.

When the temperature and the humidity of the surrounding environment of the photoreceptor drum 51 changes (increases), or when the development bias is changed in accordance with the rotary driving time of the developing roller 541, the surface potential of the photoreceptor drum 51 reduces to a lower level than a proper value. Therefore, in such a case, the second charging control unit 5272 determines the output voltage (the grid voltage) which is applied to the grid electrode 5213 by the grid voltage applying unit 523 to be the correction grid voltage Vg2 which is higher than the initial grid voltage Vg1 with reference to the second information stored in the storage unit 526. The second charging control unit 5272 causes the grid voltage applying unit 523 to output the grid voltage at the determined correction grid voltage Vg2 under constant voltage control. Thus, the above-described concerns, such as increase in ozone generation amount or the like, may be reduced as much as possible. Therefore, the charging device 52 that is able to maintain the surface potential of the photoreceptor drum 51 at the predetermined charging potential V1 which is suitable for development in accordance with a change factor of the surface potential of the photoreceptor drum 51 may be provided.

An embodiment has been described above, but the present disclosure is not limited thereto and various modifications to the embodiment may be made.

In the above-described embodiment, a configuration in which the first charging control unit 5271 determines a charging current that is caused to flow by the discharge voltage applying unit 522 in accordance with the detection value of the first factor parameter, which has been detected by the first factor parameter detection unit 5251, has been described, but the present disclosure is not limited to the above-described configuration. The first charging control unit 5271 may be configured to execute, in addition to correction of the charging current for the discharge wire 5211, correction of the output voltage (the grid voltage) which is applied to the grid electrode 5213 by the grid voltage applying unit 523 in accordance with the detection value of the first factor parameter, which has been detected by the first factor parameter detection unit 5251. Note that, in this case, the first information that is stored in the storage unit 526 is information in which the first factor parameter, the charging current of the discharge voltage applying unit 522, and the output voltage (the grid voltage) of the grid voltage applying unit 523 are associated with one another. That is, when the surface potential of the photoreceptor drum 51 is reduced to the surface potential V2 which is lower than the predetermined charging potential V1 by change in layer thickness due to a shave of the organic photosensitive layer 512, which has been caused by use of the photoreceptor drum 51, the first charging control unit 5271 executes, in addition to correction of the charging current for the discharge wire 5211, correction of the output voltage (the grid voltage) which is applied to the grid electrode 5213 by the grid voltage applying unit 523 with reference to the first information stored in the storage unit 526. Thus, even when the amount of change in surface potential of the photoreceptor drum 51 due to change in layer thickness of the organic photosensitive layer 512 is large, the surface potential of the photoreceptor drum 51 may be maintained at the predetermined charging potential V1 which is suitable for development in a state in which concerns, such as increase in ozone generation amount or the like, are reduced as much as possible.

What is claimed is:

1. A charging device that is attached to an image forming device including a photoreceptor in which a photosensitive layer that is able to carry an electrostatic latent image is formed on a surface thereof and which is rotationally driven and a developer carrying body which carries a developer, is rotationally driven, and develops the electrostatic latent image by the developer with a predetermined developing bias applied thereto, and charges the surface of the photoreceptor in advance of carrying the electrostatic latent image, the charging device comprising:

a charging unit that includes a discharge electrode that generates corona discharge between the photoreceptor and the discharge electrode and a grid electrode arranged between the discharge electrode and the photoreceptor and charges the surface of the photoreceptor to a predetermined charging potential;

a discharge voltage applying unit that outputs a discharge voltage that is to be applied to the discharge electrode under constant current control;

a grid voltage applying unit that outputs a grid voltage that is to be applied to the grid electrode under constant voltage control;

a parameter detection unit that detects a first factor parameter that is a parameter that is a change factor of a surface potential of the photoreceptor that has been charged by the charging unit and corresponds to change in layer thickness change of the photosensitive layer in the photoreceptor and a second factor parameter other than the first factor parameter;

a storage unit that stores a predetermined charging potential which is a target default value of the surface potential in the photoreceptor, an initial charging current value in an initial state, an initial grid voltage value, first information in which the first factor parameter and a charging current that flow when the discharge voltage is applied to the discharge electrode of the discharge voltage applying unit are associated with one another, and second information in which the second factor parameter and an output voltage of the grid voltage applying unit are associated with one another; and a control unit that controls the discharge voltage applying unit and the grid voltage applying unit such that the surface potential of the photoreceptor is the predetermined charging potential, wherein the control unit includes:

a first charging control unit that determines a charging current of the discharge voltage applying unit, which corresponds to a detection value of the first factor parameter, which has been detected by the parameter detection unit, with reference to the predetermined charging potential which is a target default value of the surface potential in the photoreceptor, the initial charging current value in an initial state, the initial grid voltage value, and the first information that are stored in the storage unit and causes the discharge voltage applying unit to output a discharge voltage with the charging current under constant current control, a second charging control unit that determines an output voltage of the grid voltage applying unit, which corresponds to a detection value of the second factor parameter, which has been detected by the parameter detection unit, with reference to the initial grid voltage value and the second information that are stored in the storage unit and causes the grid voltage applying unit to output a grid voltage at the output voltage under constant voltage control, and the second factor parameter is information of at least one of temperature and humidity information of a surrounding environment of the photoreceptor and information related to a rotary driving time of the developer carrying body.

2. The charging device according to claim 1, wherein the first factor parameter is information of at least one of a rotary driving time, the number of rotations, a travel distance of the photoreceptor.

3. The charging device according to claim 1, further comprising:

a grid voltage adjusting unit that is coupled between the grid electrode and the grid voltage applying unit and maintains the grid voltage that has been applied to the grid electrode by the grid voltage applying unit constant.

4. The charging device system according to claim 3, wherein the grid voltage adjusting unit is formed of at least one of a variable resistance element and a constant voltage element.

5. An image forming device comprising:

a photoreceptor in which a photosensitive layer that is able to carry an electrostatic latent image is formed on a surface thereof and which is rotationally driven;

a developer carrying body which carries a developer, is rotationally driven, and develops the electrostatic latent image by the developer with a predetermined developing bias applied thereto; and the charging device of claim 1, which charges the surface of the photoreceptor in advance of carrying the electrostatic latent image.

* * * * *